US009040124B2

(12) United States Patent
Przychocki

(10) Patent No.: US 9,040,124 B2
(45) Date of Patent: May 26, 2015

(54) DUAL CURE METHOD FOR INK FOR INCREASED DURABILITY AND ADHESION TO GOLF BALLS

(75) Inventor: Michael Przychocki, Elgin, IL (US)

(73) Assignee: Illinois Tool Works Inc., Glenview, IL (US)

( * ) Notice: Subject to any disclaimer, the term of this patent is extended or adjusted under 35 U.S.C. 154(b) by 366 days.

(21) Appl. No.: 12/425,215

(22) Filed: Apr. 16, 2009

(65) Prior Publication Data

US 2009/0297728 A1 Dec. 3, 2009

Related U.S. Application Data

(60) Provisional application No. 61/056,892, filed on May 29, 2008.

(51) Int. Cl.

| | |
|---|---|
| ***B05D 3/00*** | (2006.01) |
| ***B05D 3/06*** | (2006.01) |
| ***A63B 45/02*** | (2006.01) |
| ***B41M 7/00*** | (2006.01) |

(52) U.S. Cl.

CPC ..... *A63B 45/02* (2013.01); *B41M 7/0081* (2013.01); *B41M 7/009* (2013.01)

(58) Field of Classification Search

CPC ..... B41M 1/40; B41M 7/0081; B41M 7/009; A63B 45/02; A63B 37/003

USPC ..... 427/500, 510, 553, 558

See application file for complete search history.

(56) References Cited

U.S. PATENT DOCUMENTS

| | | | | |
|---|---|---|---|---|
| 4,003,868 | A * | 1/1977 | Smith et al. | 522/103 |
| 5,820,943 | A | 10/1998 | Huang | |
| 5,827,134 | A * | 10/1998 | Sullivan et al. | 473/372 |
| 6,013,330 | A * | 1/2000 | Lutz | 427/511 |
| 6,099,415 | A | 8/2000 | Lutz | |
| 6,248,804 | B1 | 6/2001 | Lutz | |
| 6,500,495 | B2 | 12/2002 | Lutz | |
| 6,523,921 | B2 * | 2/2003 | Codos | 347/8 |
| 2006/0089419 | A1 * | 4/2006 | Hogge et al. | 522/174 |

FOREIGN PATENT DOCUMENTS

| | | |
|---|---|---|
| WO | 9837982 | 9/1998 |

* cited by examiner

*Primary Examiner* — Michael Wieczorek

(74) *Attorney, Agent, or Firm* — Levenfeld Pearlstein, LLC

(57) ABSTRACT

A method is disclosed for curing ink printed images on golf balls by printing an image onto a golf ball and exposing the printed image to infrared radiation, then exposing the printed image to ultraviolet radiation.

4 Claims, No Drawings

DUAL CURE METHOD FOR INK FOR INCREASED DURABILITY AND ADHESION TO GOLF BALLS

BACKGROUND OF THE INVENTION

The present invention is directed to a cure method for ink on printed golf balls. More particularly, the present invention pertains to a quick dual cure method for increased durability and adhesion of ink to printed golf balls using both infrared and ultra-violet light.

In addition to traditional play on the golf course, marketing firms have found that personalized golf balls are an effective way to advertise. Golf balls are also used as holiday gifts, party favors, and baby arrival announcements. In each of these situations, the golf ball has some manner of printing on it, whether to show a manufacturer's name or logo, mass advertising or personalized announcements. Consumers, therefore, want the printed image on the golf balls to be durable and resistant to chipping, peeling, or other types of wear and tear.

Current practice for decorating golf balls often utilizes UV curable ink chemistries. Ultra-violet curable ink has been found to have better adhesion performance, faster curing, and longer pot life than other types of ink. However, even using ultraviolet curable ink, the printed ink on golf balls can fade, chip, scratch or completely wear away with repeated strikes to the surface. The ink can also smear or smudge if the ink has not cured fully, ruining the image printed on the ball.

Another problem is that many of the golf balls manufactured today have chemically resistant coatings which effect the ink adhesion. As a result, even the ultra-violet curable inks will not adhere well and can be easily damage or removed.

Accordingly, there is a need for an improved method to increase the adhesive qualities and durability of a printed image on golf balls, while having limited energy transfer and nominal affect on the performance and properties of the golf ball, and has a decreased overall cure time.

BRIEF SUMMARY OF THE INVENTION

A method is disclosed for curing printed ink images on golf balls by printing an image onto a golf ball, exposing the printed image to infrared radiation, and then exposing the printed image to ultraviolet radiation.

DETAILED DESCRIPTION OF THE INVENTION

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

It should be further understood that the title of this section of this specification, namely, "Detailed Description Of the Invention", relates to a requirement of the United States Patent Office, and does not imply, nor should be inferred to limit the subject matter disclosed herein.

A method for curing printed ink images on golf balls is herein disclosed. The golf ball is decorated with a UV-curable ink, such as, but not limited to, ultra-violet cureable inks, available from Illinois Tool Works, Trans Tech, and then exposed to a dual curing process. First, the printed area of the golf ball is exposed to infrared radiation, then the printed image is exposed to ultraviolet radiation. The infrared radiation effectively transfers heat energy to the ink more readily than to the golf ball surface, thus minimizing any changes to the physical properties of the ball.

The dual IR/UV cure radiates heat energy to a concentrated area where the printing is located. This enables the heat to cure the decorated area while imparting minimum energy to the ball. It is important to note that IR curing relies on radiant heat transfer to heat the surface to which it is directed. No air or other transfer medium is required. Dual curing not only increases adhesion of the ink to the surface of the golf ball, but also increase its durability and resistance to image loss from chipping, scratching, and cracking. In addition, the method retains and enhances the performance of the UV curable ink significantly.

Testing of printed images on golf balls using different curing methods revealed unexpected results. It was found that curing the printed image with infrared radiation prior to a second curing with ultraviolet radiation increased the ink's adhesion and durability as compared to other curing methods.

A cannon test, an industry test in which golf balls are launched at specified feet per second for a specific amount of cycles at a back plate, was performed for each variation. As shown in TABLES 1-4, changes were made to ink content, image thickness, pretreatment and curing method. Many inks were tested and data from a representative group of the inks are displayed below.

TABLE 1

| IMAGE USING ONLY UV LIGHT | NUMBER OF CYCLES AND PERCENT DEGRADATION OF IMAGE | | | | | | | |
|---|---|---|---|---|---|---|---|---|
| CURING | 6 | 13 | 23 | 33 | 43 | 53 | 73 | 100 |
| UV Ink #1 | NL | NL | 0.50% | 0.50% | 1.00% | 1.50% | 2% | 5% |
| UV Ink #2 | NL | 2% | 2.00% | 3% | 5.00% | 7.00% | 15% | 20% |
| UV Ink #3 | 1% | 1% | 1% | 2% | 3% | 4% | 10% | 30% |
| UV Ink #4 | 5% | 8% | 10% | 12% | 14% | 16% | 20% | 30% |

TABLE 1 illustrates the results when several varieties of UV-curable inks were used to print images on the golf balls. The balls were each printed with an image using different UV curable inks and then cured using the traditional method of UV energy curing. The balls were subsequently subjected to the cannon test. The amount of image loss, defined as cracking, chipping, or scratching, after a prescribed number of cycles was determined for each ink type and the date recorded. The image loss ranged from 5% to 30% depending on the type of ink used. UV ink #1 had the least image loss after 100 cycles when compared to the other varieties of UV ink.

TABLE 2

| IMAGE USING ONLY UV LIGHT | NUMBER OF CYCLES AND PERCENT DEGRADATION OF IMAGE | | | | | |
|---|---|---|---|---|---|---|
| CURING | 6 | 13 | 23 | 53 | 73 | 100 |
| UV Ink #1 Black | NL | NL | 0.50% | 1.50% | 2.00% | 5.00% |
| UV Ink #1 Red | NL | NL | 0.50% | 1.50% | 2.00% | 5.00% |

TABLE 2 illustrates the results of the cannon test performed on golf balls having an image made of UV-curable ink #1, with either black or red pigments. It is to be noted that while red and black pigments were used, all colors and shades, including fluorescents and metallics, are contemplated and within the scope and spirit of the present invention The image was printed onto the ball and traditional UV light was used to cure the balls. After six (6) and thirteen (13) cycles, the black inks and the red inks showed negligible loss of image. After twenty-three (23) cycles, however, both the red and black inks showed at least 0.5% image loss. This loss increased to 1.5% after fifty-three (53) cycles and to approximately 2% loss after 72 cycles. After 100 cycles, the black ink and the red ink images showed at least 5% or more image loss when using only the UV light curing method. Thus, even though UV curing has many advantages, when used alone the UV-curing method still has significant image loss with repeated use of the golf ball.

To understand how different curing methods and surface pre-treatments affect the integrity of the image, TABLE 3 shows different contemplated methods of curing and/or pre-treatments and the outcome.

TABLE 3

| | | | |
|---|---|---|---|
| UV Ink #1 Black<br>UV Ink #1 Red | Infrared (IR) curing followed by Ultra-Violet (UV) curing | 1%<br>1% | POST PRINTING TREATMENT |

TABLE 3 illustrates that the inks using the dual-cure method suffered the least percentage of image loss in testing. Those in which the image was printed onto the golf ball and then dual cured, first with IR radiation, then with UV radiation. These dual-cured golf balls suffered one percent (1%) or less image loss, even after 100 cycles in the cannon test. While UV curable ink was used in the tests, it is contemplated that other curable inks will exhibit similar increase in adhesivity and durability to golf balls when combined with the dual cure method.

TABLE 4 compares conventional curing method to the present dual curing of golf balls, oven heating in place of infra-red before UV curing and 24 hour air drying of the printed image before UV curing.

TABLE 4

| | % DEGRADATION AFTER | | | |
|---|---|---|---|---|
| TYPE OF CURING METHOD | 25 CYCLES | 50 CYCLES | 75 CYCLES | 100 CYCLES |
| Oven Bake | 0.10% | 0.20% | 0.30% | 1% |
| 24 hour air dry | 0.20% | 0.60% | 0.70% | 1.60% |
| Normal UV Cure | 0.50% | 0.50% | 1.00% | 2.80% |
| DUAL CURE | 0.30% | 0.30% | 0.50% | 1% |

The IR treated golf balls retained significantly more of its image when compared to 24 hour air drying and conventional UV curing when subjected to the cannon test. When compared to the oven bake method, the image on the oven baked golf ball did retain approximately the same image percentage as the dual cure method, which indicates that the heat imparted into the ink in both cases is the effective component that improves the ink performance, however there are several disadvantages to the oven bake cure method.

Oven curing uses a combination of radiant (from oven walls/elements) and conduction (via surrounding air) heat transfer. Rather than directing heat toward only the image, the oven bake cure undesirably heats the entire ball and imparts more total energy into the ball to achieve the same desired temperature of the ink. Furthermore, heating the entire ball, rather than just the image, can change the ball's properties and/or performance. In addition, oven heating is much more complicated to integrate into a production machine than IR radiation treatment.

On the other hand, the exposure of the printed image to the infrared energy of the present invention is beneficial in several ways. First, the infrared energy can decrease the length of cure time, while maintaining the beneficial increase in adhesion & wear resistance, without distorting or yellowing the Golf Balls caused from exposure to heat.

Second, the dual cure method enhances the adhesive properties of ink to aged or ink resistant golf balls. The aged golf balls have more of a resistance to the adhesion of ink to the surface of the balls. The dual cure method greatly enhances the adhesiveness and durability of the image on aged golf balls, as well as on golf balls from different manufacturers.

Finally, the advantages of dual method curing also includes increased control, as well as simplification of the decorating process. Infrared radiation heats the surface of the desired area quickly, without affecting the remaining portions of the balls and heats the specific area with limited total energy transfer. In addition, IR radiation can be easily incorporated into a decorating machine, thus eliminating the need to transfer balls from one device to another.

In conclusion, the dual curing method herein disclosed has many advantages over other methods of curing UV curable ink on golf balls. The dual cure method increases the adhesive qualities and durability of a printed image on golf balls, while having limited energy transfer and nominal affect on the performance and properties of the golf ball, with less overall cure time.

All patents referred to herein, are incorporated herein by reference, whether or not specifically done so within the test of this disclosure.

In the present disclosure, the words "a" or "an" are to be taken to include both the singular and the plural. Conversely, any reference to plural items shall, where appropriate, include the singular.

From the foregoing, it will be observed that numerous modification and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A dual cure method for curing printed ink on a golf ball, the method comprising:

printing an image onto a surface of a golf ball using an UV curable ink, the image covering an area less than the entire surface of the ball;

exposing only the printed area to infrared radiation, wherein the infrared radiation is directed to the area where the image is printed for a suitable duration of time to allow the image to cure on the surface for a first time;

subsequently exposing the area where the image is printed to ultraviolet radiation, for a suitable duration of time to allow the image to cure on the surface for a second time; and wherein the printed area after the dual cure method has an image loss of no greater than approximately one (1) percent, when subjected to 100 cycles of the 'cannon' golf ball decoration durability test.

2. The method of curing printed ink on a golf ball of claim 1, wherein the dual cure method increase the adhesion of the printed ink on the golf ball.

3. The method of curing printed ink on a golf ball of claim 1, wherein the dual cure method increase the durability of the printed ink on the golf ball.

4. The method of curing printed ink on a golf ball of claim 1, wherein the dual cure method increases the longevity of the printed ink on the golf ball.

* * * * *